US009228432B2

(12) United States Patent
Hutin

(10) Patent No.: US 9,228,432 B2
(45) Date of Patent: Jan. 5, 2016

(54) ZERO SUM PRESSURE DROP MUD TELEMETRY MODULATOR

(75) Inventor: Remi Hutin, New Ulm, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1011 days.

(21) Appl. No.: 13/297,850

(22) Filed: Nov. 16, 2011

(65) Prior Publication Data

US 2012/0146807 A1 Jun. 14, 2012

Related U.S. Application Data

(60) Provisional application No. 61/421,277, filed on Dec. 9, 2010.

(51) Int. Cl.
*G01V 3/00* (2006.01)
*E21B 47/18* (2012.01)
*E21B 47/00* (2012.01)

(52) U.S. Cl.
CPC ..... *E21B 47/182* (2013.01)

(58) Field of Classification Search
CPC ..... E21B 47/185; E21B 21/10; E21B 47/18; E21B 47/187
USPC ..... 340/854.3–854.5; 367/83–85, 76
See application file for complete search history.

(56) References Cited

U.S. PATENT DOCUMENTS 6,174,001 B1 1/2001 Enderle
2003/0016164 A1* 1/2003 Finke ..... E21B 47/185 342/83
2004/0012500 A1* 1/2004 Hahn ..... E21B 47/18 340/854.4
2004/0156265 A1* 8/2004 Lavrut ..... E21B 47/18 367/83
2010/0245121 A1* 9/2010 Reed ..... E21B 47/18 340/855.4
2012/0127829 A1* 5/2012 Sitka ..... E21B 47/185 367/83

FOREIGN PATENT DOCUMENTS

EP 0728909 8/2000
WO 2011/011005 1/2011

OTHER PUBLICATIONS

T. Lasseter, M. Karakas, J. Schweitzer, "Interpreting an RFT-Measured Pulse Test with a Three-Dimensional Simulator," SPE 14878, Mar. 1988.
G.F. Bunn, L.M. Yaxley, "Design, Implementation, and Interpretation of a Three-Dimensional Well Test in the Cormorant Field, North Sea", SPE 15858, Oct. 1986.
J. Saeedi, E. Standen, "Layer Pulse Testing Using a Wireline Formation Tester," SPE 16803 Sep. 1987.
(Continued)

*Primary Examiner* — Firmin Backer
*Assistant Examiner* — Jerold Murphy
(74) *Attorney, Agent, or Firm* — Chadwick A. Sullivan; Wesley Noah

(57) ABSTRACT

A method and arrangement for mud telemetry having components of a wellbore casing, a combination rotor stator positioned inside the wellbore casing, an uphole detection arrangement configured to sense increases and decreases in pressure, a valve actuator, a valve configured to be actuated by the valve actuator, the valve configured to convey a fluid from an inside of the wellbore casing to an outside of the wellbore casing and cause a decrease in fluid pressure in the wellbore casing, and a downhole tool configured to measure at least one formation parameter.

18 Claims, 6 Drawing Sheets

(56) References Cited

OTHER PUBLICATIONS

G.F. Bunn, M.J. Wittman, W.D. Morgan, R.C. Curnutt, "Distributed Pressure Measurements Allow Early Quantification of Reservoir Dynamics in the Jene Field," SPE 17682, Mar. 1991.

L.M. Yaxley, J.M. Blaymires, "A Field Example of Interference Testing Across a Partially Communicating Fault," SPE 19306, 1989.

R. Kaneda, J. Saeedi, L.C. Ayestaran, "Interpretation of a Pulse Test in a Layered Reservoir," SPE 19306, Dec. 1991.

* cited by examiner

ZERO SUM PRESSURE DROP MUD TELEMETRY MODULATOR

CROSS REFERENCE TO RELATED APPLICATIONS

This application claims the benefit of U.S. Provisional Application 61/421,277 filed Dec. 9, 2010, the entirety of which is incorporated by reference.

FIELD OF THE INVENTION

Aspects described relate to mud pulse telemetry operations. More specifically, aspects relate to a zero sum pressure drop mud telemetry modulator.

BACKGROUND INFORMATION

Drilling for hydrocarbons provides many challenges to operators that must be overcome, including, but not limited to, adverse field conditions. To that end, drilling for hydrocarbons can be cost intensive and complicated according to the size of the hydrocarbon field encountered, the overburden characterization and other similar issues.

Many times, formation conditions are measured by a downhole tool. Afterward it is desired to transmit the measured parameters from the downhole environment to an uphole environment. There are different methodologies that can be used to transmit signals from the downhole environment to an uphole environment. One such method is a wireline measurement system. Wireline measurement systems may be used to transmit information between two locations. Such wireline measurement systems have the distinct disadvantage, however, of requiring the cessation of drilling and often the removal of downhole components before the wireline apparatus may be inserted into the wellbore. While wireline measurement systems may be accurate in the characterization of data downhole, significant problems remain with such systems. As drilling must be discontinued to allow the wireline tool to be inserted, drillers lose valuable drilling time where they make measurements with wireline tools. Drillers are interested in methods and systems that prevent the need for drilling stoppage, thereby increasing profitability of field operations.

One such method to increase the profitablility of field operations is a measure while drilling ("MWD") technology called mud pulse telemetry. Drilling fluid, commonly known as "mud" is used to lubricate and cool downhole drillstring components. Mud pulse telemetry uses coded drilling fluid pressure pulses that are generated downhole to follow the "mud flow" path to the uphole arrangement. Pressure signals sent from downhole travel uphole are detected by an uphole arrangement and decoded. Using this technology, drillers are capable of measuring formation features and subsequently capable of transferring this information to the uphole environment during the drilling process, greatly increasing profitability. Specifically, mud pulse telemetry may be used to transmit data related to measured formation temperature, pressure and other values that are of value to drillers.

Transmitting the data obtained from downhole tool measurements using mud pulse telemetry, however, can be a complicated operation. Conventional apparatus have a capability of transmitting information at approximately twelve (12) bits per second. Conventional apparatus have problems associated with signal strength, erosion and pressure drop across the tool used to send the signals from the downhole environment.

Conventional apparatus (using mud pulse telemetry technology) also have a very distinct disadvantage using mud pulse telemetry technology. Conventional mud pulse telemetry technology uses a series of pressure spikes, created downhole, to send information from the downhole environment to the uphole environment. These pressure spikes, however, can lead to premature mud pump failure as the mud pumps are stressed from a period of relatively low fluid friction to a very high fluid friction state. Information may be transferred from point to point, but the systems used to accomplish this task go through repetitive cycles of overpressurization. This overpressurization leads to stress and eventual failure of the mud pumps, potentially damaging further equipment, such as expensive drill bits and downhole tools. Conventional systems may also overstress the formation going from a low pressure condition to a high pressure condition.

There is a need to provide systems and methods that allow for mud pulse telemetry from a downhole environment to an uphole environment superior to the conventionally used technologies.

DETAILED DESCRIPTION

Figure 1:
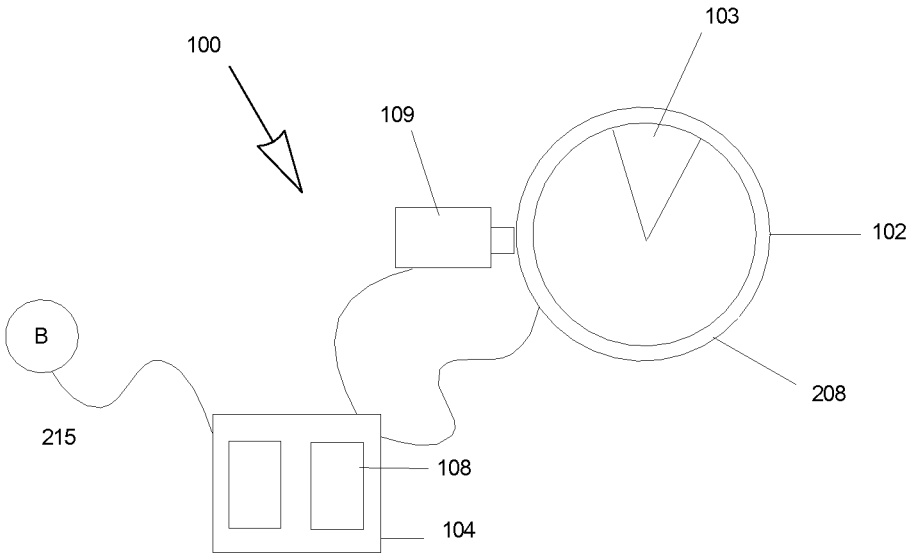
FIG. 1 is a schematic view of a portion of a zero sum pressure drop telemetry modulator.

It is to be understood that the following disclosure provides many different examples, for implementing different features of various embodiments. Specific examples of components and arrangements are described below to simplify this disclosure. These are merely examples and are not intended to be limiting. In addition, this disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which additional features may be formed interposing the first and second features, such that the first and second features may not be in direct contact.

In one aspect, one section of a mud pulse telemetry system 100 is illustrated. A combination rotor/stator 102 is illustrated. The combination rotor/stator 102 is used to create, for example, a pressure pulse or a series of pressure pulses downhole in a wellbore representing data of data to be transmitted from the downhole environment to an uphole environment. The combination rotor/stator 102 provides a movable/rotatable rotor that rotates in relation to a stationary stator. In an alternative embodiment, the stator may be a spinning stator that spins with a known frequency. In alternative configurations, the rotor and stator may be separate sections and not a combined unit. Removed sections 103 of the rotor and stator may allow or impede the flow of mud (fluid) through the borehole so that pressure pulses are created within the mud flow. The removed sections 103 are in both the rotor and the stator to allow, at the discretion of the operator, unimpeded flow of drilling fluid through the combination rotor/stator 102. Carefully controlled motion/rotation of the combination rotor/stator 102 allows for a signal or series of signals to be generated downhole and later received uphole. In one embodiment, the frequency of the spin of the rotor is controlled by a control arrangement 104 that contains a rotor/stator control module 108. In one example embodiment, the combination rotor/stator 102 may have a direct current electrical feed and integrated motor 109. In another example embodiment, the combination rotor/stator 102 may be supplied electricity through a turbine that is actuated by drilling fluid that travels through the turbine. In the instance of an integrated motor 109, the motor 109 may be run off different direct current values, such as 28 volt or 36 volt unit. In an example embodiment with an alternator or turbine, the alternator or turbine may also be connected to other downhole components, as necessary, such as downhole tools, to provide power to those components. Direct power may also be provided through batteries. In another aspect, an inline valve may be used as an alternate solution to the combination rotor/stator 102 to create the mud pulse/mud pulses.

The rotor/stator control module 108, is a chip on PC board combination, in one non-limiting embodiment, that provides for monitoring and controlling the rotation of the combination rotor/stator 102 such that signals may be sent from the downhole environment to the uphole environment. The rotor/stator control module 108 is configured to receive signals from a downhole tool, for example and convert those signals to a modulated signal to be sent by the combination rotor/stator 102 to the environment uphole. The combination rotor/stator 102 rotation frequency is controlled electronically through electrical actuation of the attached motor 109. Frequency of the rotation can be determined through direct connection to the integrated motor 109 and the control arrangement 104 or may be accomplished through a separate connection to the control arrangement 104 configured to monitor frequency.

The motor 109 actuating the combination rotor/stator 102 may be a direct drive unit, thus spinning the rotor at a desired rate or may be a magnetically driven unit. In either alternative embodiment, the motor 109 may be configured with an overspeed protection device to prevent catastrophic failure of the motor 109 from high speeds induced by rapid mud flow. The motor 109 may be a self powered unit or may be fed electrical power from a connection within a tool. The motor 109 may be a configured to prevent fluid from entering the control module 108, thereby allowing the motor 109 to be submersible in fluids and to withstand pressures anticipated within a borehole environment.

The combination rotor/stator 102, although illustrated as having only one opening, may incorporate more than one opening for fluid, such as drilling mud, to flow through the combination rotor/stator 102 when the configuration is in an "open" position. In an alternate configuration, a "closed" configuration, the combination rotor/stator 102 prevents fluid flow through the combination so that a pressure pulse in the drilling fluid can be created. The combination rotor/stator 102, in the illustrated embodiment, is made of stainless steel to prevent corrosion and ensure long service life within the wellbore environment. The combination rotor/stator 102 is provided such that flow ranges from under fifty (50) gallons per minute to over one thousand (1,000) gallons per minute for sizes larger than nine (9) inch, for example, are maintained. In one non-limiting embodiment, the maximum pressure inside the wellbore is twenty thousand (20,000) pounds per square inch. Calculations of pressures may include drilling mud specific gravity, pipe size, pump capacity and running speed of the pump and non-limiting factors for such calculations.

The combination rotor/stator 102 is configured with a fault protection system to prevent damage to the combination rotor/stator 102. The fault protection system is configured such that an operator may identify a fault condition and take corrective action. Such fault conditions can include, for example, a jammed condition for the combination rotor/stator 102. Notification may occur to an operator at the surface of the jammed condition. Such jammed condition can result from materials preventing movement of the rotor despite attempted actuation. Actions may be taken, such as termination of signal transmission, when a jammed condition is identified. The combination rotor/stator 102 may also be equipped to operate with variable operating conditions, as well as operational functions that would allow for prevention of deleterious conditions. One such operational function is a self cleaning mode that allows the combination rotor/stator 102 to be free of materials by entering either a low or fast rotation mode, unclogging and/or dislodging accumulated debris.

The combination rotor/stator 102 may be equipped with internal screens. In an alternative configuration, the internal screens may be deleted. In embodiments where no screens are used, these configurations are used to minimize clogging of the combination rotor/stator 102. In embodiments where screens are used, the screens can help create a more laminar fluid flow through the combination rotor/stator 102 to aid in pressure pulse propagation. The screens may be used to direct the pressure pulses generated by the combination rotor/stator 102. In the embodiments provided, the combination rotor/stator 102 may be replaced by a controlled valve or by an oscillating rotor/stator for all examples.

As will be understood, time of travel for pressure pulses is dependent on the depth of hole as well as the constitution of the drilling fluid. The system provided, therefore, may be configured to keep track of the depth of the hole during drilling so that proper timing of the reception of pulses may be maintained. Tracking may be performed by a well logging computer, monitored by an operator in the uphole environment. As time of flight of the pressure pulses is also contingent upon temperature, temperature of the uphole environment as well as the downhole environment may be monitored, providing a more accurate calculation.

Figure 2:
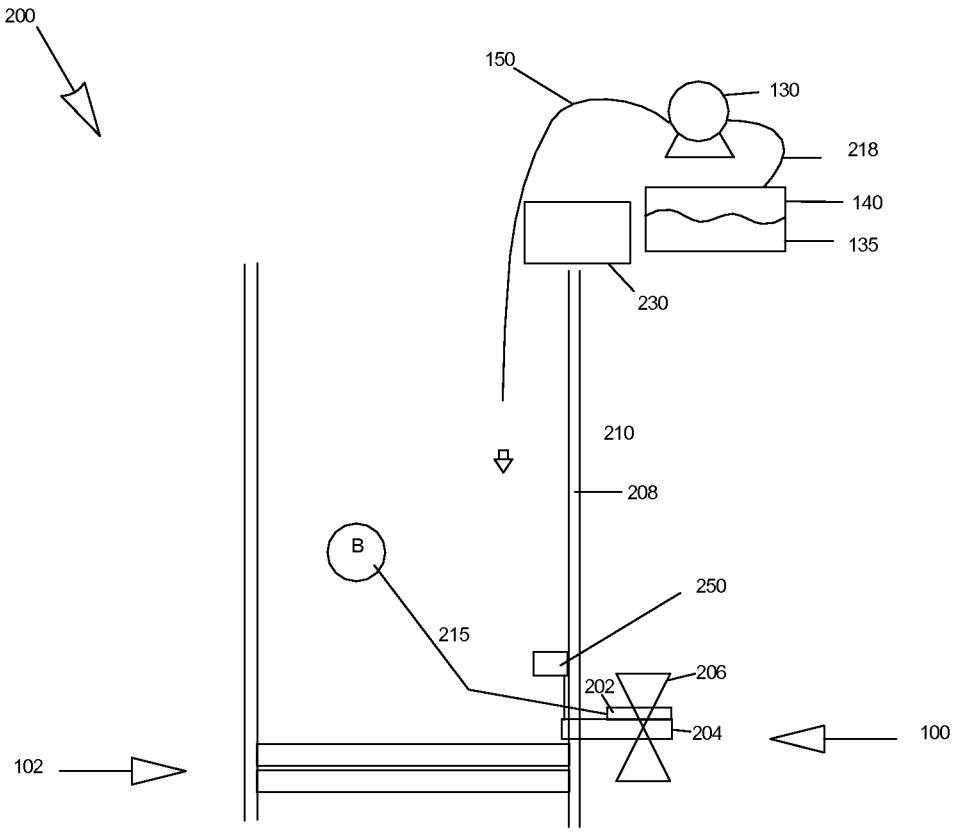
FIG. 2 is a schematic view of a second portion of the zero pressure drop telemetry modulator.

Pressure pulses are detected uphole, by a detection unit 230, see FIG. 2, that is configured to receive and interpret the signals created from the downhole environment. As illustrated in FIG. 2, the combination rotor/stator 102 is placed across a wellbore, in the illustrated embodiment from inside wall to inside wall of the wellbore. The detection unit 230, in one non-limiting embodiment, is a pressure transducer that receives mud pressure pulses transmitted by the combination rotor/stator 102. The pressure pulses may be a single pressure pulse or may be multiple pressure pulses (i.e. a series of pressure pulses). In an embodiment that uses a pressure transducer to receive mud pressure pulses, the transducer may be configured to output received pressure pulses in a waveform to a reading device, such as a computer or signal processor to interpret or decode the received signals.

Figure 3:
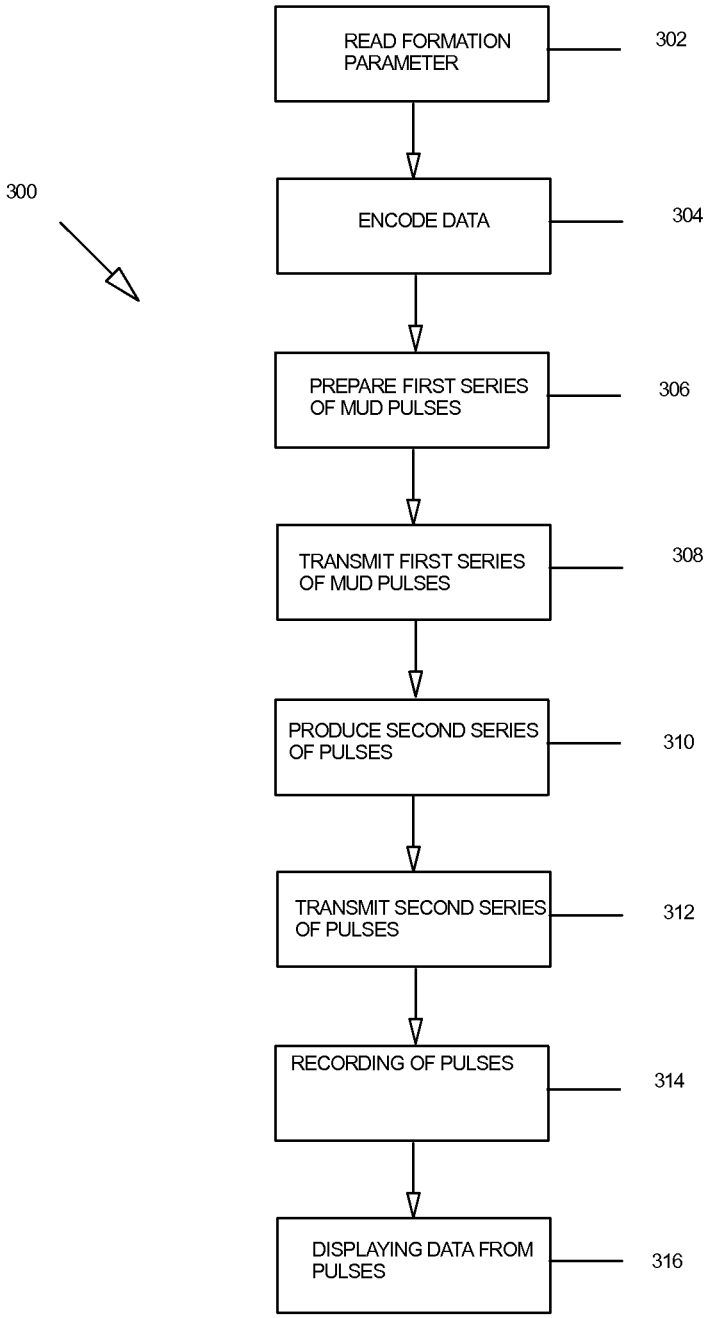
FIG. 3 is a flowchart for a method to send signals from a downhole environment to an uphole environment using a zero pressure drop mud pulse telemetry modulator.

Referring to FIG. 3, a method 300 to send signals from a downhole environment to an uphole environment using a zero pressure drop mud pulse telemetry modulator is presented. As provided in FIG. 3, a formation parameter is read, for example, by a downhole tool 302. The data regarding the formation parameter may then be encoded 304. A first series of pulses is then prepared by the mud pulse telemetry system 306. The pulses are transmitted from the downhole environment to an uphole environment 308. A second series of pulses is then prepared "encoded" wherein the second series of pulses are "negative" pressure pulse/pulses in the fluid 310. The second series of pulses is then transmitted from the downhole environment to the uphole environment to a detection arrangement 312. The pulses may be recorded 314 and then displayed 316, as necessary after appropriate decoding. During the recording, the pulses may be decoded/demodulated, as necessary. Alternatively, in step 314, the pulses may be directly decoded. In an alternative configuration, the second pulse or series of pulses may be "positive" and the first pulse or series of pulses may be "negative".

Figure 5:
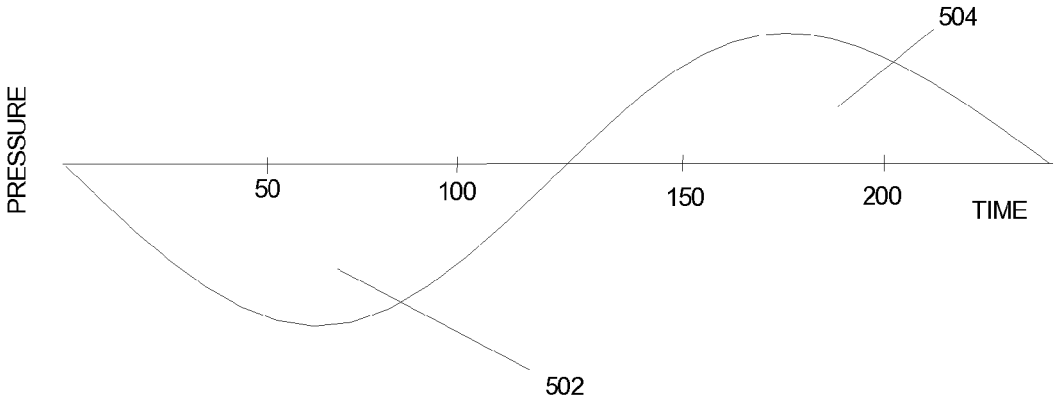
FIG. 5 is a sine wave pressure pulse, showing positive and negative pressure features.

Referring to FIG. 5, a sine wave of pressure generated by the arrangements illustrated and described is illustrated. As is presented in FIG. 5, the sine wave of pressure has two distinct components. The configuration provided in FIG. 1 provides the positive pressure component 504 of the pressure wave. The peak of the pressure pulse may be maintained below a desired peak level such that mud pumps do not have any deleterious consequences through control of the openings in the combination rotor/stator 102. In one example embodiment, the pressure may be kept below a desired level by increasing the amount of open area that is exposed during rotation of the rotor. Decrease of the amount of open area between the rotor and stator will increase the amount of pressure for the system. The "negative" pressure component 502 of the sine wave is discussed below.

Referring to FIG. 2, a negative pressure section 200 of the mud telemetry system is presented, wherein the negative pressure pulse component 502 of FIG. 5 is produced. As will be understood, the negative component is a pressure value that is decreased from a reference value. The negative component is thus not necessarily a suction or negative value as compared to a zero value, but is rather a decrease value as compared to the positive pressure value. A drilling fluid/mud pump 130 is connected to a drilling fluid/mud tank 140. Inside the mud tank 140, the drilling mud 135 is contained at a temperature and consistency that is needed for activities downhole. A pump intake line 218 draws drilling mud 135 from the mud tank 140 through action of the mud pump 130. The drilling mud 135 is then expelled from the mud pump 130 into an annulus 210 of a wellbore 208. In the illustrated embodiment, the annulus may be any size wellbore 208.

In the illustrated embodiment, the mud pump 130 may be a positive displacement pump, centrifugal pump, piston driven pump or any fluid actuation system for flow. Drilling mud 135 expelled into the wellbore travels down to a valve 206 that is actuated by a valve actuator 202. Signals for valve actuation are transferred through control line 215 connected to valve actuator 202. Upon a signal actuation transferred to the valve 206 through the control line 215, the valve actuator 202 opens the valve 206, presenting a clear passage to an annulus 210 area. Drilling mud 135 traveling down the wellbore 208 may enter the pipe 204 and exit to the annulus 210 area. Further signals provided through the control line 215 can be used to further actuate the valve actuator 202 thus closing the valve 206. In such instances, drilling mud 135 may not enter the connected pipe 204, thus exit of mud is restricted.

Detection unit 230 is further configured to detect the physical effects of actuation of the valve 206, thus essentially measuring a negative pressure, with respect to the positive pressure pulse previously described. Referring to FIG. 5, the detection unit 230 allows for measuring of the negative pressure region 502 presented. The detection unit 230, through the two systems being controlled, measures both the positive and negative pressure pulses illustrated in FIG. 5.

The magnitude of the negative pressure pulse is controlled by the size of the opening of the pipe 204 and the speed of actuation. Larger area openings of the pipe 204 allow more drilling fluid 135 to exit to the annulus 210, thus decreasing the pressure pulse. Lesser area openings of the pipe 204 allow less drilling fluid to exit to the annulus 210, thus limiting the pressure decrease.

As the systems will be subjected to harsh conditions, all bearings for the combination rotor/stator 102 have configurations that limit foreign material from entering the bearings to ensure long life. Thus, all bearings may be sealed units that are self lubricated.

Pressure sensors provided in the detection unit 230 may be, as non-limiting examples, piezoresistive strain type, capacitive and optical type sensors. In the illustrated embodiment, multiple pressure sensors are used to provide redundancy of the pressure sensing capability.

Valve actuators 202 may be hydraulic or electric actuators. Valve actuators 202 may be part-turn actuators for fast response within the system. The valve actuators 202, in the illustrated embodiment, have a motor (not shown) that may be a direct or alternating current type motor. The motor may be configured with a limit switch or may have a torque sensor to prevent bending/breaking of valve 206 components upon actuation. The motor may also be provided with position indicators such that visual identification may be used to determine valve position by field personnel upon removal of the valve actuator from a wellbore, allowing operators to quickly identify problems with equipment. Additional capability for providing valve position data can also be provided to the operator for remote reading capability.

The valve 206 used in the embodiments shown may be a motor controlled valve, as a non-limiting example. The valve 206 provided may have gaskets, such as Teflon gaskets, that prevent material intrusion. The body of the valve 206 may be made of stainless steel, as illustrated, or may be cast iron, alloy steel, brass or bronze, as non-limiting examples. Seats of the valve may be formed to provide a leak-tight seal. Seats may be hard seats or soft seats, as necessary to the application. Hardened seats may be used, for example, when wear is an issue and where a small amount of fluid leakage is permitted. Soft seats may be used, for example, when a leak tight seal is desired. Types of valves can be, as non-limiting embodiments, butterfly, needle, ball, plug and diaphragm valves.

Valve stems may be durable components that interact with their associated valve actuators to permit the internals of the valve 206 within the respective valve bonnets to actuate. For ball valves used in these applications, ball valve internals may be made titanium or stainless steel for durability.

In applications where a needle valve is used, the needle valve may be made of titanium or stainless steel for durability. The needle valve may additionally be threaded for easy removal or installation in the wellbore downhole configuration.

In all applications where valves are used, preventative measures may be taken such that valve chatter is reduced or eliminated. Appropriate connection is maintained between the valve 206 and valve actuator 202 such that excessive play is eliminated and precise opening of the valve 206 is maintained.

The systems provided (both positive pulse and negative pulse) consider pressure pulse reflection and feedback to minimize data corruption and increase data accuracy. As can be understood, pressure pulses may reflect off different surfaces, thereby causing difficulty in obtaining accurate received data. Pressure pulses may reflect off uneven sides of the wellbore casing or components placed within the drill string. To that end, pressure pulse reflection may cause significant disturbance during detection of pulses. Detectors may inadvertently detect multiple signals, when only one signal was sent. The other signals detected arrive at a later time as the pressure pulse deflects along the fluid path. The detection unit 230 is configured to identify the presence of degraded or reflected pressure pulses and eliminate these pulses from consideration during decoding of the signals. The detection unit 230 is also configured such that minor pressure fluctuations in the drilling fluid are ignored. Such pressure fluctuations may be caused, for example, from mud pumps. Mechanical and/or pressure noise may be generated at the mud pump and affect detecting equipment in the wellbore. Mechanical noise may be monitored through a separate system connected to the detection unit 230. The mechanical noise may be filtered out from the pressure sensed by the detecting unit 230. To perform such an analysis, the detection unit 230 may be configured with a memory and appropriate processor so that detected pump noise may be filtered more accurately.

The detection unit 230 may be configured such that only positive pressure pulses be recognized, only negative pressures recognized or both positive and negative pressure pulses. The detection unit 230, through this configuration, alleviates any problems with high frequency noise or low frequency noise as the detection unit 230 can be configured to ignore pressure pulses that are spurious. Through this configuration mud pump cyclic noise either from piston, turbine or mechanical action imparting motion on the fluid may be ignored or compensated for in the detection of pressure pulses.

A separate detection unit 250 may placed such that uphole and downhole communications are possible. The separate detection unit 250 may be configured such that only positive pressure pulses are recognized, only negative pressures recognized or both positive and negative pressure pulses. Activation/deactivation of mud pumps, for example, may be used for providing pressure pulses to the downhole detection unit 250.

The embodiments provided have very significant benefits that are useful while drilling. The embodiments provided minimize overpressurization of the formation. Overpressurization occurs when relatively soft materials are drilled or the pressure used during drilling exceeds the sheer force capability of the surrounding formation, as a non-limiting example. Overpressurization may lead to drilling fluid penetration into the formation 115, (see FIG. 4), contaminating fluids ultimately recovered. More environmentally friendly alternatives during drilling are constantly sought, including minimization of chemicals and materials used to create wellbores. By limiting intrusion of fluids into the overall formation, such methods become possible.

For very high rates of pressure pulses, in conventional systems, there can be "smearing" or combination such that the pulses run together and are harder to differentiate. In the embodiments provided, the effects of "smearing" or combination of pulses is solved as pulses are not just created by pressure spikes in the fluid, but also be pressure dips in the fluid. As a result, smearing is less of a concern as there is less of a need for having very high rates of pressure pulses as the data transfer rate is effectively doubled compared to convention systems using positive pressure systems. Eliminating such high rate pressure pulses also allows components in the system to be more durable, enhancing system reliability.

One significant advantage of the aspects described is that the systems and methods may be used during different drilling conditions that would be inapplicable for conventional apparatus and methods. Underbalanced drilling conditions are often used in drilling operations related to hydrocarbon recovery. Underbalanced drilling conditions exist when the pressure inside the wellbore is kept at a value lower than the subsurface formations at the drilling bit. Such conditions prevent invasion of drilling mud into the formation. Aspects described allow for transfer of data from the downhole configurations under such underbalanced drilling conditions, while maintaining underbalanced conditions. Use during underbalanced conditions can have very significant advantages, including minimization of drilling fluid and less contamination of the formation around the wellbore.

Aspects presented allow for the use of the methods and systems presented such that "torque noise" is also eliminated from consideration when detecting pressure with the detecting unit 230. Torque noise is defined as movement of the drill string in jumping movements due to the grabbing and subsequent release of the drill bit 116 (see FIG. 4) as the drill bit 116 grabs, cuts and releases formation 115 materials. The detection units 230 and 250 are configured, in one non-limiting embodiment, to identify the presence of torque noise and eliminate this noise generated during drilling operations. Such noise has, in one embodiment, a fairly constant frequency that may be filtered out during processing.

In the illustrated embodiments, the combination rotor/stator 102 may be configured such that an override feature is provided, wherein during sampling of fluid, the combination rotor/stator 102 may be interrupted if such interruption is necessary, for example, to perform formation evaluation.

The detection units 230 and 250 may each be configured with a memory. The memory may be a volatile or non-volatile unit. The memory may be configured to store time-stamped or counted/sensed events. Control circuitry for the detection units 235, 250 may be programmable to cause an action, such as actuation of a valve or other component response to a sensed event or an elapsed time or operator order. An operator interface may be provided so that interaction may be performed between downhole components. The operator interface may also allow an operator to alter the programming of the control circuitry for the detection units 230 and 250.

In the illustrated embodiment, a pressurizer may be installed in the outlet line of the mud pump. The pressurizer allows intake of drilling fluid "mud" from the exit of the mud pump and keeps the exit conditions of the mud at a constant pressure for sending downhole. The pressurizer allows for elimination of pressure perturbations created through the mud pump. The pressurizer allows for small variations in pressure to be absorbed so that a uniform stream of drilling fluid is conveyed downhole.

Figure 4:
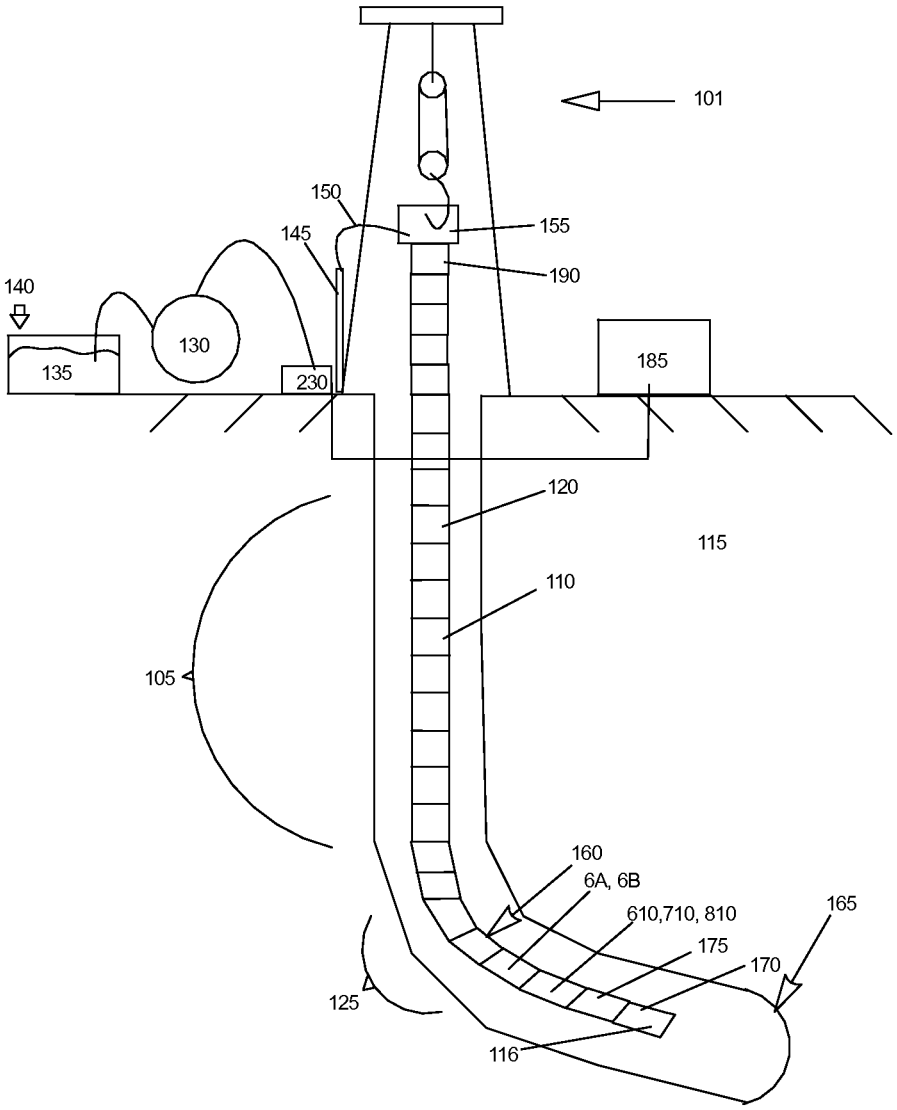
FIG. 4 is a schematic view of a drilling rig using a mud pulse telemetry system in accordance with one embodiment of the invention.

An example well site system is schematically depicted in FIG. 4 wherein components described above are incorporated in the larger systems described in FIG. 4. The well site comprises a well. A drill string 105 may extend from the drill rig 101 into a zone of the formation of reservoir 115. The drill string 105 employs the mud pulse telemetry system, described in FIG. 1 and FIG. 2, for transmitting data from downhole to the surface as well as transmitting data from the uphole environment to the downhole environment.

The drill string 105 may also employ any type of telemetry system or any combination of telemetry systems, such as electromagnetic, mud pulse, acoustic and\or wired drill pipe, however in the preferred embodiment, only the mud pulse telemetry system, described in FIG. 1 and FIG. 2 is used. A bottom hole assembly is suspended at the end of the drill string 105. In one embodiment, the bottom hole assembly comprises a plurality of measurement while drilling or logging while drilling downhole tools 125, as illustrated in FIG. 4 such as shown by numerals 6*a* and 6*b*. For example, one or more of the downhole tools 6*a* and 6*b*. may be a formation pressure while drilling tool.

Logging while drilling tools used at the end of the drill string 105 may include a thick walled housing, commonly referred to as a drill color, and may include one or more of a number of logging devices. The logging while drilling tools may be capable of measuring, processing, and/or storing information therein, as well as communicating with equipment disposed at the surface of the well site.

Measurement while drilling tools may include one or more of the following measuring tools: a modulator, a weight on bit measuring device, a torque measuring device, a vibration measuring device, a shock measuring device, a stick slip measuring device, a direction measuring device, and inclination measuring device, and/or any other device.

Measuring made by the bottom hole assembly or other tools and sensors with the drill string 105 may be transmitted to a computing system 185 for analysis. For example, mud pulses may be used to broadcast formation measurements performed by one or more of the downhole tools 6*a* and 6*b* to the computing system 185 sent to the detection unit 230 via the mud pulse telemetry system, as illustrated in FIGS. 1 and 2.

The computing system 185 is configured to host a plurality of models, such as a reservoir model, and to acquire and process data from downhole components, as well as determine the bottom hole assembly location in the reservoir 115 from measurement while drilling data. Examples of reservoir models and cross well interference testing may be found in the following references:"Interpreting an RFT-Measured Pulse Test with a Three-Dimensional Simulator" by Lasseter, T., Karakas, M., and Schweitzer, J., SPE 14878, March 1988. "Design, Implementation, and Interpretation of a Three-Dimensional Well Test in the Cormorant Field, North Sea" by Bunn, G. F., and Yaxley, L. M., SPE 15858, October 1986. "Layer Pulse Testing Using a Wireline Formation Tester" by Saeedi, J., and Standen, E., SPE 16803, September 1987. "Distributed Pressure Measurements Allow Early Quantification of Reservoir Dynamics in the Jene Field" by Bunn, G. F., Wittman, M. J., Morgan, W. D., and Curnutt, R. C., SPE 17682, March 1991. "A Field Example of Interference Testing Across a Partially Communicating Fault" by Yaxley, L. M., and Blaymires, J. M., SPE 19306, 1989. "Interpretation of a Pulse Test in a Layered Reservoir" by Kaneda, R., Saeedi, J., and Ayestaran, L. C., SPE 19306, December 1991.

The derrick or similar looking/functioning device may be used to move the drill string 105 within the well that is being drilled through subterranean formations of the reservoir, generally at 115 in FIG. 4. The drill string 105 may be extended into the subterranean formations 115 with a number of coupled drill pipes (one of which is designated 120) of the drill string 105. The drill pipe comprising the drill string 105 may be structurally similar to ordinary drill pipes, as illustrated for example and U.S. Pat. No. 6,174,001, issued to Enderle, entitled "Two-Step, a Low Torque, Wedge Thread for Tubular Connector," issued Aug. 7, 2001, which is incorporated herein by reference in its entirety. The drill pipe 120 may be standard drill pipe.

The bottom hole assembly at the lower end of the drill string 105 may include one, an assembly, or a string of downhole tools. In the illustrated example, the downhole tool string 105 may include well logging tools 125 coupled to a lower end thereof. As used in the present description, the term well logging tool or a string of such tools, may include at least one or more logging while drilling tools ("LWD"), formation evaluation tools, formation sampling tools and other tools capable of measuring a characteristic of the subterranean formations of the reservoir 115 and\or of the well.

Several of the components disposed proximate to the drill rig 101 may be used to operate components of the system provided in FIG. 1 and FIG. 2. These components will be explained with respect to their uses in drilling the well 110 for a better understanding thereof. The drill string 105 may be used to turn and actually urge a drill bit 116 into the bottom the well 110 to increase its length (depth). During drilling of the well 110, a pump 130 lifts drilling fluid (mud) 135 from a tank 140 or pits and discharges the mud 135 under pressure through a standpipe 145 and flexible conduit 150 or hose, through a top drive 155 and into an interior passage inside the drill string 105. The mud 135 which can be water or oil-based, exits the drill string 105 through courses or nozzles (not shown separately) in the drill bit 116, wherein it cools and lubricates the drill bit 116 and lifts drill cuttings generated by the drill bit 116 to the surface of the earth through an annular arrangement.

When the well 110 has been drilled to a selected depth, the well logging tools 125 may be positioned at the lower end of the pipe 105 if not previously installed. The well logging tools 125 may be positioned by pumping the well logging tools 125 down the pipe 105 or otherwise moving the well logging tools 125 down the pipe 105 while the pipe 105 is within the well 110. The well logging tools 125 may then be coupled to an adapter sub 160 at the end of the drill string 105 and may be moved through, for example in the illustrated embodiment, a highly inclined portion 165 of the well 110, which would be inaccessible using armored electrical cable to move the well logging tools 125. The mud telemetry modulator may be positioned at or near the bottom of the well 110.

During well logging operations, the pump 130 may be operated to provide fluid flow to operate one or more turbines (not shown in FIG. 4) in the well logging tools 125 to provide power to operate certain devices in the well logging tools 125. When tripping in or out of the well 110, it may be infeasible to provide fluid flow. As a result, power may be provided to the well logging tools 125 in other ways. For example, batteries may be used to provide power to the well logging tools 125. In one embodiment, the batteries may be rechargeable batteries and may be recharged by turbines during fluid flow. The batteries may be positioned within the housing of one or more of the well logging tools 125. Other manners of powering the well logging tools 125 may be used including, but not limited to, one-time power use batteries.

As the well logging tools 125 are moved along the well 110 by moving the string 105, signals may be detected by various devices, of which non-limiting examples may include a resistivity measurement device, a bulk density measurement device, a porosity measurement device, a formation capture cross-section measurement device 170, a gamma ray measurement device 175 and a formation fluid sampling tool 610, 710, 810 which may include a formation pressure measurement device 6*a* and/or 6*b*. The signals may be transmitted toward the surface of the earth along the drill string 105.

An apparatus and system for communicating from the drill string 105 to the surface computer 185 or other component configured to receive, analyze, and/or transmit data may include a second adapter sub 190 that may be coupled between an end of the drill string 105 and the top drive 155 that may be used to provide a communication channel with a detecting unit 230 for signals received from the well logging tools 125. The detecting unit 230 may be coupled to the surface computer 185 to provide a data path therebetween. As will be understood and previously explained, data transfer may be a bidirectional data path between the surface and the downhole environment.

Though not shown, the drill string 105 may alternatively be connected to a rotary table, via a Kelly, and may suspend from a traveling block or hook, and additionally a rotary swivel. The rotary swivel may be suspended from the drilling rig 101 through the hook, and the Kelly may be connected to the rotary swivel such that the Kelly may rotate with respect to the rotary swivel.

An upper end of the drill string 105 may be connected to the Kelly, such as by threadingly reconnecting the drill string 105 to the Kelly, and the rotary table may rotate the Kelly, thereby rotating the drill string connected thereto. Though a rotary drilling system is shown in FIG. 4, other drilling systems may be used without departing from the scope of the present disclosure.

Although not shown, the drill string 105 may include one or more stabilizing collars. A stabilizing collar may be disposed within or connected to the drill string 105, in which the stabilizing collar may be used to engage and apply a force against the wall of the well 110. This may enable the stabilizing collar to prevent the drill pipe string 105 from deviating from the desired direction for the well 110. For example, during drilling, the drill string 105 may "wobble" within the well 110, thereby allowing the drill string 105 to deviate from the desired direction of the well 110. This wobble action may also be detrimental to the drill string 105, components disposed therein, and the drill bit 116 connected thereto. A stabilizing collar may be used to minimize, if not overcome altogether, the wobble action of the drill string 105, thereby possibly increasing the efficiency of the drilling performed at the well site and/or increasing the overall life of the components at the wellsite.

Referring to FIG. 5, a pressure sine wave developed for the system is illustrated. A negative section 502 is produced by the valve arrangements provided in FIG. 2. A positive section 504 is produced by the arrangements provided in FIG. 1. The sum-total of the systems provided in FIG. 1 and FIG. 2 produce the graph of the pressure pulse provided in FIG. 5. As described in the above and below description, the zero-sum pressure refers to positive and negative pressure pulse capacity that may be summed, in certain instances, to provide a zero sum series of pulses. Although illustrated as sine waves, other types of waves may be used, including, but not limited to, rectangular, saw tooth, and cosine waves.

Figure 6:
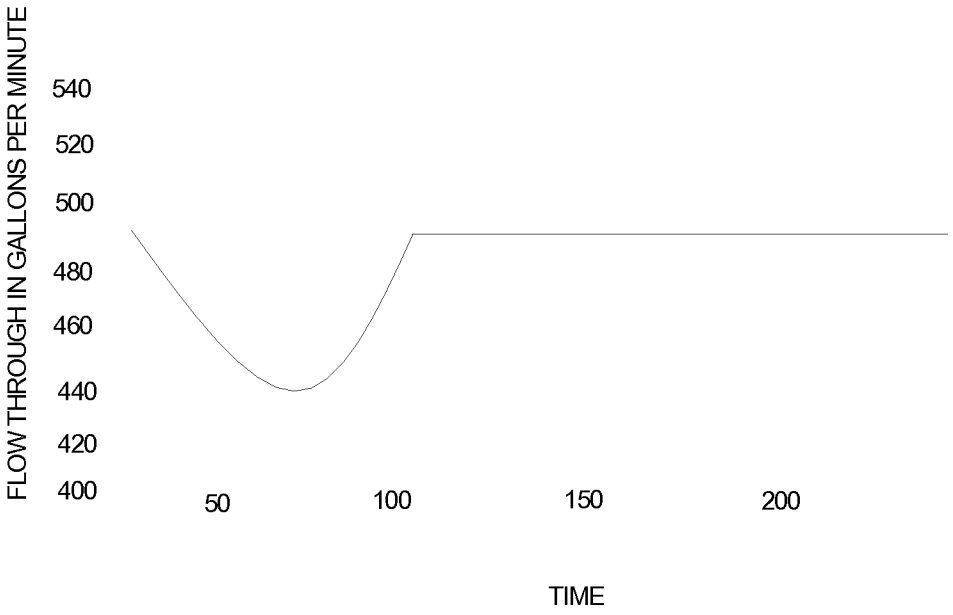
FIG. 6 is a average flow through a tool incorporating the zero sum pressure drop telemetry modulator.

Referring to FIG. 6, a graph of flow over time is provided for the system provided in FIGS. 1 and 2. In the illustrated embodiment, the average flow is 476 gallons per minute or a nominal reduction of only 5% of the average flow in a wellbore. The system, thus, provides increased functionality, with minimal effects on the overall performance.

In embodiments provided with direct connection between components, such as between a valve actuator and the valve, as a non-limiting example, connection may be made through a magnetic coupling and not through direct mechanical connection. Use of magnetic coupling between components allows for creation of a limitation on the stress that will be exerted on a component if an obstruction or fault occurs. By using magnetic coupling, interconnection between components can be terminated if excessive resistive forces are measured. Mechanical connections may also be used in other alternative embodiments.

The arrangement provided allows for operation in different temperatures. Mud pulse telemetry can be performed in temperatures at approximately zero (0) degrees Celsius to over two hundred (200) degrees Celsius. The methods and apparatus may be used in environments that conventional mud pulse telemetry systems operate.

In one embodiment an arrangement is described comprising at least one drill pipe, a combination rotor/stator positioned inside the at least one drill pipe, the combination rotor/stator configured to create a pressure pulse in a fluid, a rotor/stator control module configured to receive data from a downhole component, wherein the rotor/stator control module is configured to act upon the combination rotor stator based upon the data from the downhole component; a valve actuator, a valve connected to the valve actuator, the valve configured to be actuated by the valve actuator, the valve configured to convey the fluid from an inside of the drill pipe to an annulus and reduce a pressure in the fluid, and an uphole detection arrangement configured to sense increases and decreases in pressure of the fluid acted upon by at least one of the combination rotor/stator and the valve.

In a further embodiment the arrangement further comprises a downhole component configured to measure at least one formation parameter and develop data for the parameter, wherein the data pertaining the at least one formation parameter is provided to the rotor/stator control module.

In a further embodiment the arrangement is provided wherein the valve is one of a needle valve, a butterfly valve and a check valve.

In a further embodiment the arrangement further comprises a detection arrangement configured downhole to receive data from an uphole environment, the detection arrangement connected to the rotor/stator control module.

In a further embodiment, the arrangement may further comprise a fluid turbine connected to at least one of the valve actuator and the combination rotor stator.

In a further embodiment, the arrangement may further comprise a demodulator unit connected to the detection arrangement.

In a still further embodiment, the arrangement may further comprise a computer connected to the detection arrangement.

In another embodiment, a method of conducting mud pulse telemetry, is described comprising preparing one of a first mud pulse and a first series of mud pulses in a fluid in a downhole environment through one of a combination rotor/stator and a valve, wherein the combination rotor/stator produces one of a positive pressure pulse and a series of positive pressure pulses and the valve creates one of a negative pressure pulse and a series of negative pressure pulses, transmitting at least one of the first mud pulse and the first series of mud pulses to a detection arrangement in an uphole environment, producing one of a second mud pulse and a second series of mud pulses in the fluid wherein the one of the second mud pulse and the second series of mud pulses is a negative pressure pulse in the fluid and transmitting the second pressure pulse to the detection arrangement.

In another embodiment, the method is accomplished wherein the one of the first pulse and the first series of pulses is encoded.

In another embodiment, the method is accomplished wherein the one of the second pulse and the second series of pulses is encoded.

In another embodiment, the method may further comprise recording at least one of the first pressure pulse and the first series of pressure pulses and one of the second pressure pulse and the second series of pressure pulses by a computer.

In another embodiment, the method may further comprise displaying at least one of the first series of pulses and the second series of pulses on the computer.

In another embodiment, the method may further comprise reading at least one formation characteristic prior to preparing the first series of mud pulses.

In another embodiment, the method may be accomplished wherein the reading of the one formation characteristic is through a downhole tool.

In another embodiment, the method may be accomplished wherein the method is accomplished while drilling.

The foregoing outlines features of several embodiments so that those skilled in the art may be better understand the aspects of the present disclosure. Those skilled in the art should appreciate that they may readily use the present disclosure as a basis for designing or modifying other processes and structures for carrying out the same purpose and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A telemetry system comprising:

at least one drill pipe;

a combination rotor/stator positioned inside the at least one drill pipe, the combination rotor/stator configured to cause an increase in fluid pressure in a fluid with respect to a reference pressure value by impeding a flow of the fluid to a downhole environment;

a valve actuator;

a valve connected to the valve actuator, the valve configured to be actuated by the valve actuator, the valve configured to convey the fluid from an inside of the drill pipe to an annulus and cause a reduction in fluid pressure in the fluid with respect to the reference pressure value;

a control module configured to receive data from a downhole component and act upon the combination rotor/stator and the valve actuator so the increase in fluid pressure and the reduction in fluid pressure form a sinusoidal waveform having a positive component corresponding to the increase in fluid pressure and a negative component corresponding to the reduction in fluid pressure; and an uphole detector configured to measure the sinusoidal waveform by detecting increases and reductions in the pressure of the fluid acted upon by the combination rotor/stator and the valve.

2. The telemetry system as recited in claim 1, wherein the combination rotor/stator does not contribute to the negative pressure component of the waveform.

3. The telemetry system as recited in claim 1, wherein the increase in fluid pressure caused by the combination rotor/stator comprises a pressure pulse.

4. The telemetry system as recited in claim 1, wherein the uphole detector comprises a pressure transducer.

5. The telemetry system as recited in claim 1, wherein the sinusoidal waveform encodes at least one formation parameter read by the downhole component.

6. The telemetry system as recited in claim 1, wherein the positive component corresponding to the increase in fluid pressure and the negative component corresponding to the reduction in fluid pressure sum to about zero.

7. A method comprising:

causing, by a valve, a reduction in fluid pressure with respect to a reference pressure value in a drill pipe by conveying a fluid from an inside of the drill pipe to an annulus of a wellbore; and causing, by at least one of a combination rotor/stator or an inline valve, an increase in fluid pressure with respect to the reference pressure value in the drill pipe, wherein the reduction in fluid pressure and the increase in fluid pressure form a waveform having a negative component corresponding to the reduction in fluid pressure and a positive component corresponding to the increase in fluid pressure, wherein the positive component corresponding to the increase in fluid pressure and the negative component corresponding to the reduction in fluid pressure sum to about zero.

8. The method as recited in claim 7, wherein the waveform comprises at least one of a sine wave, a cosine wave, a rectangular wave, or a saw tooth wave.

9. The method as recited in claim 7, wherein the combination rotor/stator does not contribute to the negative pressure component of the waveform.

10. The method as recited in claim 7, wherein the increase in fluid pressure caused by the combination rotor/stator comprises a pressure pulse.

11. The method as recited in claim 7, further comprising measuring the waveform by detecting the increases and reductions in fluid pressure with respect to the reference pressure value.

12. The method as recited in claim 7, wherein the waveform encodes at least one formation parameter read by a downhole component.

13. A telemetry system comprising:

a valve configured to cause a reduction in fluid pressure with respect to a reference pressure value in a drill pipe by conveying a fluid from an inside of the drill pipe to an annulus of a wellbore; and at least one of a combination rotor/stator or an inline valve configured to cause an increase in fluid pressure with respect to the reference pressure value in the drill pipe, wherein the reduction in fluid pressure and the increase in fluid pressure form a waveform having a negative component corresponding to the reduction in fluid pressure and a positive component corresponding to the increase in fluid pressure, wherein the positive component corresponding to the increase in fluid pressure and the negative component corresponding to the reduction in fluid pressure sum to about zero.

14. The telemetry system as recited in claim 13, wherein the waveform comprises at least one of a sine wave, a cosine wave, a rectangular wave, or a saw tooth wave.

15. The telemetry system as recited in claim 13, wherein the combination rotor/stator does not contribute to the negative pressure component of the waveform.

16. The telemetry system as recited in claim 13, wherein the increase in fluid pressure caused by the combination rotor/stator comprises a pressure pulse.

17. The telemetry system as recited in claim 13, further comprising a pressure transducer configured to measure the waveform by detecting the increases and reductions in fluid pressure with respect to the reference pressure value.

18. The telemetry system as recited in claim 13, further comprising a downhole component, the waveform encoding at least one formation parameter read by the downhole component.

* * * * *